US009278557B2

(12) United States Patent
Honda

(10) Patent No.: US 9,278,557 B2
(45) Date of Patent: Mar. 8, 2016

(54) SHEET PROCESSING APPARATUS AND METHOD FOR PROCESSING SHEETS

(71) Applicants: KABUSHIKI KAISHA TOSHIBA, Minato, Tokyo (JP); TOSHIBA TEC KABUSHIKI KAISHA, Shinagawa, Tokyo (JP)

(72) Inventor: Masashi Honda, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/290,201

(22) Filed: May 29, 2014

(65) Prior Publication Data

US 2015/0343808 A1 Dec. 3, 2015

(51) Int. Cl.

| | |
|---|---|
| ***B41M 7/00*** | (2006.01) |
| ***B41J 13/00*** | (2006.01) |
| ***B41J 2/32*** | (2006.01) |

(52) U.S. Cl.

CPC ..... *B41J 13/0009* (2013.01); *B41J 2/32* (2013.01); *B41M 7/009* (2013.01); *B41M 7/0009* (2013.01)

(58) Field of Classification Search

USPC ..... 347/179

See application file for complete search history.

(56) References Cited

U.S. PATENT DOCUMENTS

| | | | | |
|---|---|---|---|---|
| 8,786,648 | B1 * | 7/2014 | Umetsu | 347/179 |
| 2012/0306985 | A1 * | 12/2012 | Iguchi et al. | 347/179 |
| 2013/0242026 | A1 * | 9/2013 | Mizutani | 347/179 |
| 2014/0240435 | A1 * | 8/2014 | Kubo | 347/179 |
| 2014/0340460 | A1 * | 11/2014 | Sugizaki | 347/179 |
| 2015/0064638 | A1 * | 3/2015 | Sugiyama | 432/1 |

FOREIGN PATENT DOCUMENTS

JP H04-356088 12/1992

OTHER PUBLICATIONS

Translation of JP 04-356088, published on Dec. 1992.*

* cited by examiner

*Primary Examiner* — Huan Tran
(74) *Attorney, Agent, or Firm* — Patterson & Sheridan, LLP

(57) ABSTRACT

A sheet processing apparatus includes a sheet conveying unit configured to convey sheets, a first scanning unit configured to scan a surface of each of the sheets conveyed by the sheet conveying unit, and generate a first image data for each of the sheets, an erasing unit configured to carry out an erasing process on the surface of each of the sheets conveyed from the first scanning unit, a second scanning unit configured to scan the surface of each of the sheets conveyed from the erasing unit, and generate a second image data for each of the sheets, and a control unit configured to cause the sheets to be sorted based on a difference between the first image data and the second image data thereof.

15 Claims, 3 Drawing Sheets

SHEET PROCESSING APPARATUS AND METHOD FOR PROCESSING SHEETS

FIELD

Embodiments described herein relate generally to a sheet processing apparatus and a method for processing sheets.

BACKGROUND

One type of a hall-point pen uses a decolorable ink. In addition, one type of a printer forms an image with a decolorable toner. The images written with the pen or formed with the printer can be erased by heating a sheet having the images. The image written with the ball-point pen can be erased, for example, with frictional heat. The image formed with the printer can be erased, for example, by heating the sheet with an erasing apparatus having a heater.

Such an erasing apparatus separates sheets on which images are successfully erased from sheets on which images cannot be erased, so that the sheets from which the images have been erased can be reused.

DETAILED DESCRIPTION

In general, according to one embodiment, a sheet processing apparatus includes a sheet conveying unit configured to convey sheets, a first scanning unit configured to scan a surface of each of the sheets conveyed by the sheet conveying unit, and generate a first image data for each of the sheets, an erasing unit configured to carry out an erasing process on the surface of each of the sheets conveyed from the first scanning unit, a second scanning unit configured to scan the surface of each of the sheets conveyed from the erasing unit, and generate a second image data for each of the sheets, and a control unit configured to cause the sheets to be sorted based on a difference between the first image data and the second image data thereof.

Hereinafter, an exemplary embodiment will fee described in detail with reference to the drawings.

Figure 1:
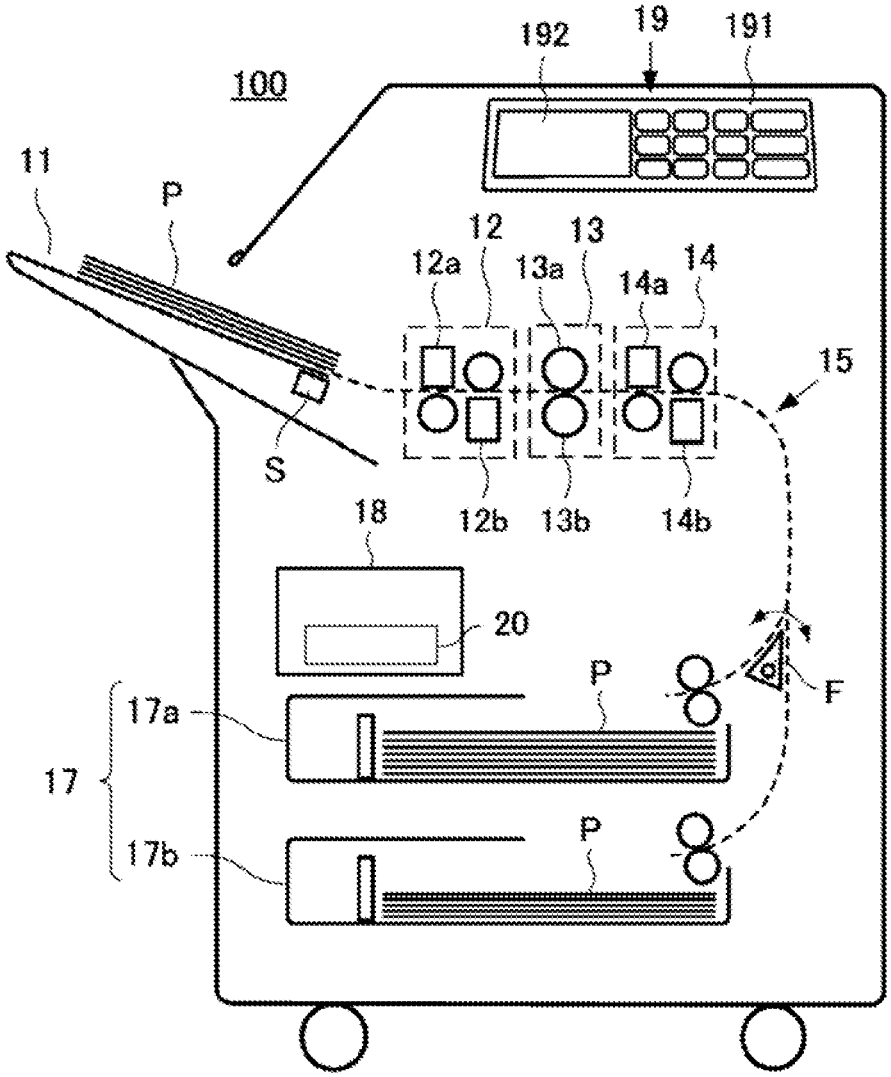
FIG. 1 is a schematic diagram showing a configuration of a sheet processing apparatus according to an embodiment.
Figure 2:
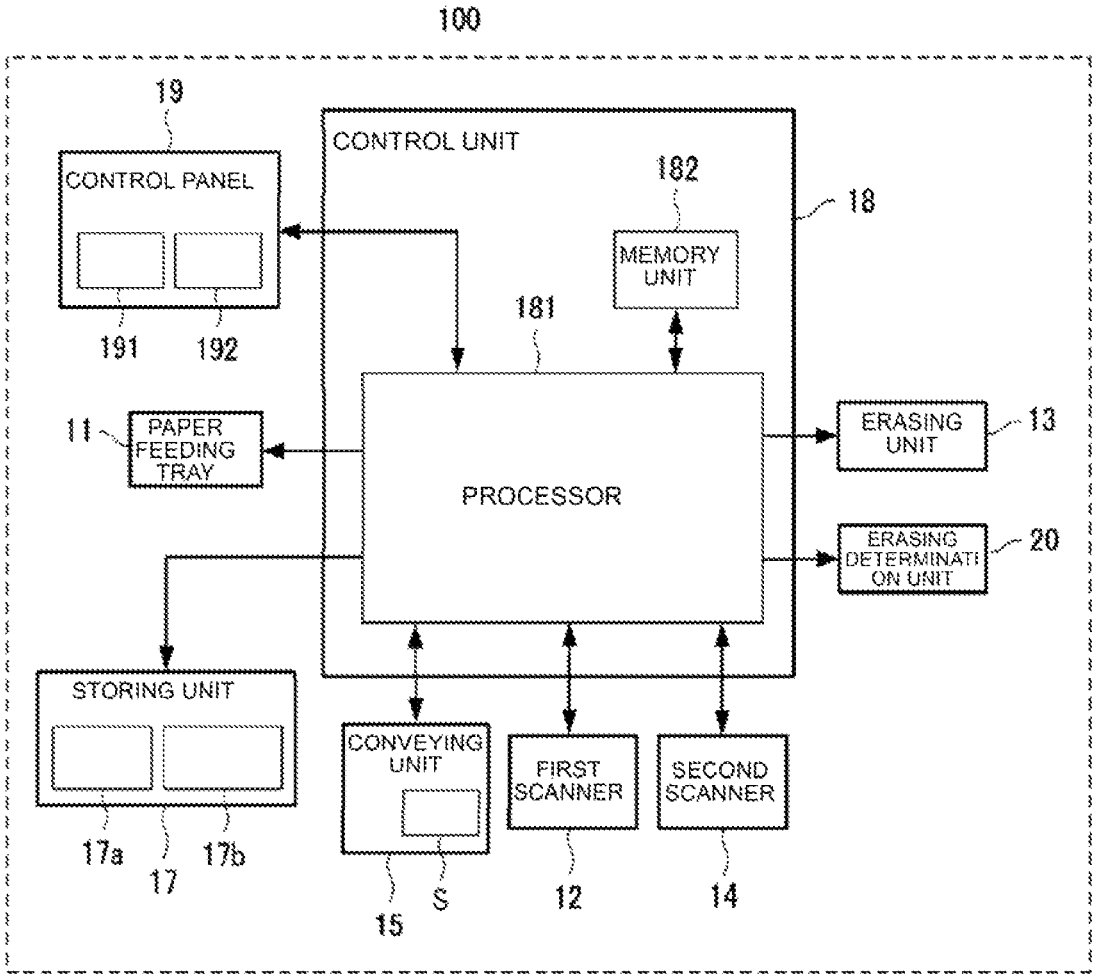
FIG. 2 is a block diagram showing a configuration of functional units of the sheet processing apparatus according to the embodiment.

FIG. 1 is a schematic diagram illustrating a configuration of a sheet processing apparatus according to an embodiment. FIG. 2 is a block diagram illustrating a configuration of functional units of the sheet processing apparatus. A sheet processing apparatus 100 shown in FIG. 1, as a whole, scans a surface of sheets with a scanner, determines whether images are printed with a decolorable toner or additionally written with a decolorable ink, and sorts the sheets based on the determination result.

The sheet processing apparatus 100 may be an independent system and may be an image forming apparatus in which a general printing function with a non-decolorable toner and a function of erasing printed or written images is switched when in use. A configuration of a function of processing sheets will be described hereinafter.

The sheet processing apparatus 100 includes a paper feeding tray 11, a first scanner 12, an erasing unit 13, a second scanner 14, a conveying unit 15, a sheet storing unit 17, a control unit 18, a control panel 19, an erasing determination unit 20, and the like.

Sheet P to be sorted are placed on the paper feeding tray 11 to be supplied. The paper feeding tray 11 also includes a sensor S that detects whether or not the sheets P are placed on the paper feeding tray 11. Each of the sheets P to be sorted includes at least an image portion printed with a decolorable ink or a decolorable toner.

The first scanner 12 scans surfaces of each of the sheets P and generates a first image data D1 corresponding to the surfaces of the sheet P. In addition, the first scanner 12 simultaneously scans both surfaces of the sheet P. The first scanner 12 is provided with charge coupled device (CCD) sensors 12*a* and 12*b* as imaging devices that are disposed above and below with, respect to a sheet conveying path, respectively and symmetrically, in order to generate the image data.

The erasing unit 13 heats the sheet P, after the first image data D1 of the sheet P is generated by the first scanner 12, to a predetermined temperature with heaters 13*a* and 13*b*. It is possible to erase the image portion printed with the decolorable ink or the decolorable toner on the sheet P through the heat treatment. The heaters 13*a* and 13*b* are disposed so as to contact with both surfaces of the conveyed sheet P, and therefore the erasing unit 13 can heat both surfaces of the sheet P. Although in this embodiment the heaters 13*a* and 13*b* are disposed on both surfaces of the sheet P as an example, the heaters are not necessarily disposed on both surfaces and may be disposed on one surface of the sheet P.

The second scanner 14 scans surfaces of the sheet P after the heat treatment and generates a second image data D2 corresponding to the surfaces of the sheet P. With the second image data D2 generated by the second scanner 14, it can be determined whether or not the imager formed on the sheet P is erased by the erasing unit 13. The second scanner 14 is configured in the same manner as the first scanner 12. The second, scanner 14 simultaneously scans both surfaces of the sheet P and includes CCD sensors 14*a* and 14*b* as imaging devices that are disposed above and below the front and rear faces of the sheet P, respectively and symmetrically, in order to generate the image data.

The imaging devices of the first and second scanners 12 and 14 that generate the image data are not limited to the CCD censor and may be a complementary metal oxide semiconductor (CMOS) sensor.

The conveying unit 15 includes a flapper F, and a transfer roller and transfer belt, which are not shown. The flapper F is supported to be freely refutable around a spindle as a center and is driven in the clockwise direction or the counterclockwise direction. The flapper F can restrict a sheet conveying direction of the sheet P. The conveying unit 15 conveys the sheet P from the paper feeding tray 11 to the first scanner 12, the erasing unit 13, and the second scanner 14 in this order.

In the sheet storing unit 17, the sheets P conveyed through the erasing unit 13 are stored on a reject tray 17*a* or a non-reject tray 17*b*. Sheets to be rejected are stored on the reject tray 17*a* and sheets not to be rejected are stored on the non-reject tray 17*b*. Whether the sheets are conveyed to the reject tray 17*a* or the non-reject tray 17*b* is determined by the rotational position of the flapper F.

The control unit 18 is a unit that collectively controls hardware of the sheet processing apparatus 100. The control unit 18 includes a processor 181 which is a calculation processing unit (for example, a central processing unit (CPU)), and a memory unit 182 including volatile and nonvolatile memory units.

The processor 181 performs varies kinds of processing in the sheet processing apparatus 100. In addition, the processor 181 also plays a role of performing various functions by executing programs stored in the memory unit 182.

The memory unit 182 includes, for example, a random access memory (RAM), a read only memory (ROM), a dynamic random access memory (DRAM), a static random access memory (SRAM), a video RAM (VRAM), a hard disk drive (HDD), and the like.

The memory unit 182 stores various types of information or programs used in the sheet processing apparatus 100. In addition, the memory unit 182 stores data or programs need to be stored in a nonvolatile manner. In addition, the memory unit 182 stores image data or the like which are generated by the first scanner 12.

The functions which are performed by the processor 181 and the memory unit 182 may also be achieved by an application specific integrated circuit (ASIC).

The control panel 19 includes an operation unit 191 and a display unit 192, receives inputs for a designation or an instruction of a parameter by a user, and displays progress state of processes and a status of the sheet processing apparatus 1 to the user. The display unit 192 may also have a function of the operation unit by employing a touch panel type display.

The erasing determination unit 20 compares image data before and after passing through the erasing unit 13 of a sheet P fed from the paper feeding tray 11 and determines whether the decolorable ink, decolorable toner, or the like is used. The determination by the erasing determination unit 20 is based on the image data obtained by scanning of the image on the sheet P by the first scanner 12 and the second scanner 14.

In the sheet processing apparatus 100 configured in this manner, it is supposed that the sheet P is loaded on the paper feeding tray 11 and the operation of the erasing is instructed from the operation unit 191 of the control panel 19. The control unit 18 drives the conveying unit 15 to convey the sheet P within the sheet processing apparatus 100.

The conveying unit 15 conveys the sheet P to the first scanner 12 according to an order of the control unit 18. The first scanner 12 generates the first image data D1 from the sheet P based on the control of the control unit 18. The first image data D1 is stored in the memory unit 182. The conveying unit 15 conveys the sheet P, after the first image data D1 is generated by the first scanner 12, to the erasing unit 13 based on the control of the control unit 18.

The erasing unit 13 heats the sheet P to a predetermined temperature. When an image on the sheet P is printed with the decolorable ink, the image is erased, for example, at a temperature of 60° C. or more. The temperature for erasing the image printed with the decolorable toner is, for example, approximately 100° C. Accordingly, it is possible to erase the image whether the image is printed with the decolorable ink or with the decolorable toner by setting the temperature to approximately 100° C. as the predetermined temperature.

Next, the conveying unit 15 conveys the sheet P to the second scanner 14 based on the control of the control unit 18. The second scanner 14 generates the image data of the sheet P, after the sheet P is subject to the heating by the erasing unit 13, based on the control of the control unit 18. The generated image data is stored in the memory unit 182 as the second image data D2.

The control unit 18 counts the number of pixels N1 corresponding to a printed image portion based on the first image data D1 stored in the memory unit 182 and counts the number of pixels N2 corresponding to a printed image portion based on the second image data D2.

Here, an example of the counting of the number of pixels N1 will be described. RGB values of each pixel generated by the first scanner 12 is compared with a threshold value stored in the memory unit 182 in advance and a difference between the RGB image data of each pixel and the threshold value is calculated. As a result of comparing the RGB value of each pixel with the threshold value, the pixel is determined to be a print pixel, i.e., a pixel corresponding to the printed image portion, when at least one of RGB values is smaller than the threshold value. On the other hand, the pixel is determined to be a white pixel, i.e., a pixel corresponding to a non-printed portion in other cases. Pixels having RGB values at least one of which is smaller than the threshold value are cumulatively counted as the print pixel throughout all pixels in the generated image data and the total number is calculated as the number of pixels N1. The number of pixels N2 is obtained through the same method as the method for calculating the number of pixels N1.

Then, the control unit 18 compares the number of pixels N1 with the number of pixels N2 stored in the memory unit 182. When the relationship of the two numbers satisfies N2<N1, the sheet is conveyed to the non-reject tray 17*b*. When the relationship of the two numbers satisfies N2≥N1, the sheet is conveyed to the reject tray 17*a*.

In this manner, the erasing states on the sheet before and after passing through the erasing unit 13 are compared to each other. It is possible to sort sheets based on whether or not the images on the sheets, where there is a possibility of alteration, are written or printed with the decolorable ink.

Figure 3:
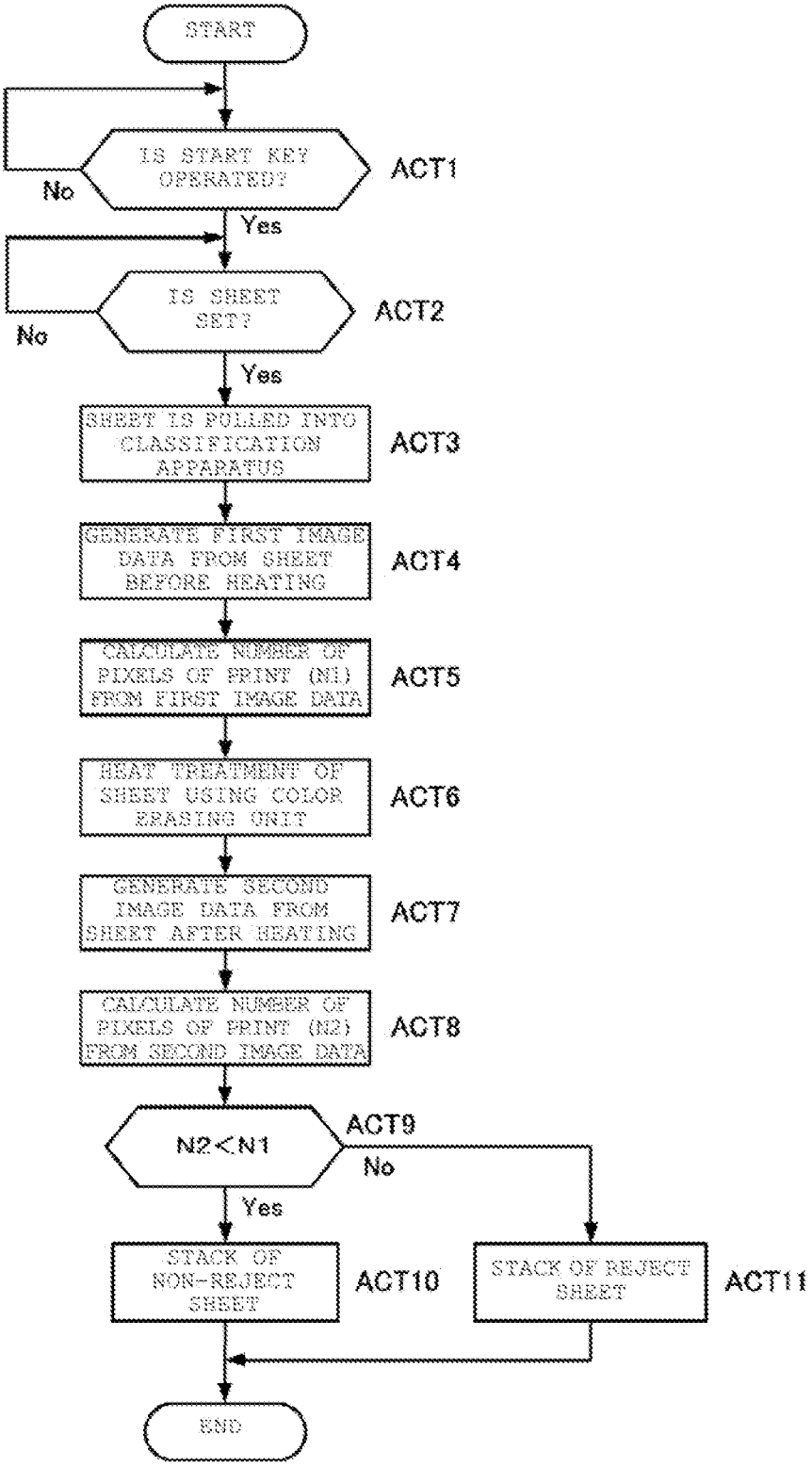
FIG. 3 is a flowchart describing an operation of the sheet processing apparatus according to the embodiment.

FIG. 3 is a flowchart of an operation of the sheet processing apparatus 100.

The control unit 18 determines whether or not a start key is operated on the operation unit 191 of the control panel 19 (ACT 1).

In ACT 1, when it is determined that the start key is operated (Yes), it is determined whether or not a sheet is set in the paper feeding tray 11 based on the detected result from the sensor S (ACT 2).

The sheet P set in the paper feeding tray 11 is not always limited to a sheet having an image printed with the decolorable toner. The sheets P may include a sheet having an image written with the decolorable ink using a ball-point pen, a sheet having an image printed with the decolorable toner, and a sheet having an image additionally written with the decolorable ink after an image is printed with a non-decolorable toner. That is, any one of a sheet with a non-decolorable image, a sheet with a decolorable image, and a sheet with decolorable and non-decolorable images may be set on the paper feeding tray 11.

When it is determined that the sheet P is set (Yes in ACT 2), the conveying unit 15 is controlled to pull the sheet P within the sheet processing apparatus 100 (ACT 3).

The printed image on the sheet P is scanned by the first scanner 12 during the conveying of the sheet P to generate the first image data D1 (ACT4).

The control unit 18 calculates the number of pixels N1 from the first image data (ACT5).

The conveying unit 15 is driven to convey the sheet P to a position of the erasing unit 13 and the sheet is heated and discharged (ACT 6). As a result of heating the sheet P, if the image on the sheet P is printed with the decolorable toner or the ink, the image is erased. Similarly, if the image includes an image portion formed with the decolorable ink and an image portion printed with the non-decolorable toner, the image portion formed with the decolorable ink is erased.

The second scanner 14 scans the surfaces of the sheet P that has passed through the erasing unit 13 to generate the second image data D2 (ACT 7).

The control unit 18 calculates the number of pixels N2 from the second image data (ACT 8). It is possible to calculate the number of pixels N2 in the same manner as the number of pixels N1.

The control unit 18 determines whether the number of pixels N2 obtained from the second image data is smaller than the number of pixels N1 obtained from the first image data (ACT 9).

If it is determined that the relationship satisfies the number of pixels N2<the number of pixels N1 (Yes in ACT 9), the sheet P is conveyed to the non-reject tray 17*b* (ACT 10).

If it is determined that the relationship does not satisfy the number of pixels N2<the number of pixels N1 (No in ACT 9), the sheet P is conveyed to the reject tray 17*a* (ACT 11).

It is possible to separate a sheet having an image formed with the decolorable ink by comparing the image data obtained before and after the sheet passes through the erasing unit 13 by performing each process described above.

In the above-described embodiment, after surfaces of sheets are scanned by a scanner, the sheets are subject to a heat treatment to the extent that images formed with the decolorable toner, the ball-point pen, or the like are erased, and then, the surfaces of the sheets are scanned again by a scanner. The sheets are sorted based on whether or not there is a difference between the image data generated by the scanners. Accordingly, it is possible to determine whether or not each of the sheets includes an image of the decolorable toner or the ball-point pen, whereby it is possible to detect alteration.

In the above-described embodiment, the first image data D1 is generated while passing the sheet P through the first scanner before passing through the erasing unit 13, and the second image data D2 is generated while passing the sheet P through the second scanner after passing through the erasing unit 13. A common scanner may be used before and after heating the sheet P with the erasing unit 13 by reversing the conveying direction of the sheet P. In this case, either one of the scanners may be removed.

In addition, for example, it is possible to scan front and rear surfaces of a sheet using a common scanner by providing an inverting mechanism to invert the sheet conveying direction of the sheet.

Furthermore, the sheet processing apparatus 100 is described as an apparatus solely used for sorting sheets between a sheet having an image print solely with a non-decolorable toner and a sheet having an image print with a decolorable ink. The sheet processing apparatus may be a complex apparatus having a function of forming an image with the decolorable toner, a function of forming an image with the non-decolorable toner, or the like.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus comprising:

a sheet conveying unit configured to convey sheets;

a first scanning unit configured to scan a surface of each of the sheets conveyed by the sheet conveying unit, and generate a first image data for each of the sheets;

an erasing unit configured to carry out an erasing process on the surface of each of the sheets conveyed from the first scanning unit;

a second scanning unit configured to scan the surface of each of the sheets conveyed from the erasing unit, and generate a second image data for each of the sheets; and a control unit configured to cause each of the sheets to be sorted based on a difference between the first image data and the second image data thereof, wherein the control unit determines the difference by determining a difference between a first number of pixels that have a color different from a color of the sheet in the first image data and a second number of pixels that have a color different from a color of the sheet in the second image data.

2. The sheet processing apparatus according to claim 1, wherein the control unit is configured to sort the sheets, by causing one or more of the sheets with respect to which the first number is larger than the second number to be separated from one or more of the sheets with respect to which the first number is equal to or smaller than the second number.

3. The sheet processing apparatus according to claim 2, further comprising:

a first sheet storing unit; and a second sheet storing unit, wherein the control unit is configured to cause the separation by controlling the sheet conveying unit to convey the sheets for which the first number is larger than the second number to the first sheet storing unit, and convey the sheets for which the first number is equal to or smaller than the second number to the second sheet storing unit.

4. The sheet processing apparatus according to claim 1, wherein the erasing unit is configured to carry out the erasing process by heating.

5. The sheet processing apparatus according to claim 1, further comprising:

a memory unit configured to store the first image data at least until the corresponding second image data is generated by the second scanning unit.

6. A method for processing sheets comprising:

scanning surfaces of sheets, each having an image portion formed of a decolorable material, and generating a first image data for each of the sheets;

carrying out an erasing process on the surface of each of the sheets after the scanning;

scanning surfaces of the sheets after the erasing process, and generating a second image data for each of the sheets;

determining, for each of the sheets, a first number of pixels that have a color different from a color of the sheet in the first image data;

determining, for each of the sheets, a second number of pixels that have a color different from a color of the sheet in the second image data;

determining, for each of the sheets, a difference between the first number and the second number;

determining, based on the difference between the first number and the second number, a difference between the first image data and the second image data of each of the sheets; and sorting each of the sheets based on the difference of each of the sheets.

7. The method according to claim 6, wherein the sorting is carried out by separating one or more of the sheets for which the first number is larger than the second number from one or more of the sheet for which the first number is equal to or smaller than the second number.

8. The method according to claim 7, wherein the separating is carried out by conveying the sheet for which the first number is larger than the second number to a first sheet storing unit, and conveying the sheets for which the first number is equal to or smaller than the second number to a second sheet storing unit.

9. The method according to claim 6, wherein the erasing process is carried out by heating.

10. The method according to claim 6, further comprising:

storing the first image data at least until the corresponding second image data is generated.

11. An image forming apparatus comprising:

an image forming unit configured to form an image on a sheet with a non-decolorable material;

a sheet conveying unit configured to convey sheets;

an erasing unit configured to carry out an erasing process on the surface of each of the sheets conveyed by the sheet conveying unit;

a scanning unit configured to scan a surface of each of the sheets before the erasing process and generate a first image data for each of the sheets, and scan the surface after the erasing process and generate a second image data for each of the sheets; and a control unit configured to cause each of the sheets to be sorted based on a difference between the first image data and the second image data thereof, wherein the control unit determines the difference by determining the difference between a first number of pixels that have a color different from a color of the sheet in the first image data and a second number of pixels that have a color different from a color of the sheet in the second image data.

12. The image forming apparatus according to claim 11, wherein the control unit is configured to sort the sheets, by causing one or more of the sheets for which the first number is larger than the second number to be separated from one or more of the sheets for which the first number is equal to or smaller than the second number.

13. The image forming apparatus according to claim 12, further comprising:

a first sheet storing unit; and a second sheet storing unit, wherein the control unit is configured to cause the separation by controlling the sheet conveying unit to convey the sheets for which the first number is larger than the second number to the first sheet storing unit, and convey the sheets for which the first number is equal to or smaller than the second number to the second sheet storing unit.

14. The image forming apparatus according to claim 11, wherein the erasing unit is configured to carry out the erasing process by heating.

15. The image forming apparatus according to claim 11, further comprising:

a memory unit configured to store the first image data at least until the corresponding second image data is generated by the second scanning unit.

* * * * *